US006940032B2

(12) United States Patent
Sirajtheen et al.

(10) Patent No.: US 6,940,032 B2
(45) Date of Patent: Sep. 6, 2005

(54) METHOD AND APPARATUS FOR ACHIEVING THREE POSITIONS

(75) Inventors: Bahrudeen Sirajtheen, Secunderabad (IN); Radhesh R. Panchal, Chatham (CA)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/755,619

(22) Filed: Jan. 12, 2004

(65) Prior Publication Data

US 2005/0150754 A1 Jul. 14, 2005

(51) Int. Cl.[7] ..... H01H 5/00
(52) U.S. Cl. ..... 200/400; 200/401
(58) Field of Search ..... 200/400, 401, 200/409, 449, 450, 453, 454, 511, 320–333

(56) References Cited

U.S. PATENT DOCUMENTS 3,875,360 A * 4/1975 Rys ..... 200/400
3,876,847 A * 4/1975 Dykes et al. ..... 200/400
4,916,268 A 4/1990 Micoud et al. ..... 200/400
4,999,598 A 3/1991 Jannesari et al. ..... 335/122
5,148,913 A 9/1992 Bonnardel et al. ..... 200/400
5,438,176 A * 8/1995 Bonnardel et al. ..... 200/400
5,448,047 A * 9/1995 Nair et al. ..... 235/440
5,672,875 A * 9/1997 Block et al. ..... 250/343
5,981,888 A * 11/1999 Robarge et al. ..... 200/400

* cited by examiner

*Primary Examiner*—Elvin Enad
*Assistant Examiner*—Lisa Klaus
(74) *Attorney, Agent, or Firm*—Cantor Colburn LLP

(57) ABSTRACT

A three position apparatus and method of operation thereof is disclosed. The apparatus includes an actuator plate a first spring assembly in operable communication with the actuator plate a second spring assembly in operable communication with the actuator plate a first drive plate in operable communication with the actuator plate and first spring assembly and a second drive plate in operable communication with the actuator plate and second spring assembly. A driver is in operable communication with the first drive plate and with the second drive plate. The three position apparatus is configured to provide quick movement of the driver to at least three discrete positions.

21 Claims, 8 Drawing Sheets

METHOD AND APPARATUS FOR ACHIEVING THREE POSITIONS

TECHNICAL FIELD

The disclosed method and apparatus relate generally to a three position apparatus, and more particularly to a three position transfer switch for transferring electrical loads from one power source to another.

BACKGROUND OF THE INVENTION

Three position apparatus have many applications. One of these applications is to use the three position apparatus as a transfer switch in an electrical power system. Such an electrical switch may be used to transfer from a normal power source to a backup power source, such transfers may occur when there is an interruption of normal power supply. The interruption of normal power supply may be caused by a variety of reasons: earthquake, flood damage, adverse weather conditions, or utility unreliability, for example. In the event that a normal power source, such as an electric utility, experiences an outage and fails, it is often necessary to supply critical and essential electrical needs by means of a standby electrical power system.

Often, the standby power supply system is an on-site electrical power source suitable to the needs of the applicable regulations and user criteria. The standby or emergency power supply system functions to provide a source of electrical power of required capacity, reliability and quality within a specified time after loss or failure of the normal power supply. The emergency power supply system varies depending upon the particular situation, for example, there may be a specified maximum time for which the load terminals of the transfer switch are permitted to be without acceptable electrical power. Quick transfer is especially important where critical equipment is involved, as in hospitals, airports and computer installations.

Accordingly, there is a need in the art for three position transfer switches that are able to handle a 400 Ampere bypass switch, able to make the transfer quickly, from about 20 milliseconds to about 100 milliseconds for example, have ease of operation, and are compact.

BRIEF DESCRIPTION OF THE INVENTION

The disclosed apparatus relates to a three position apparatus comprising: an actuator plate; a first spring assembly in operable communication with the actuator plate; a second spring assembly in operable communication with the actuator plate; a first drive plate in operable communication with the actuator plate and first spring assembly; a second drive plate in operable communication with the actuator plate and second spring assembly; a driver in operable communication with the first drive plate and with the second drive plate; and wherein the three position apparatus is configured to provide quick movement of the driver to at least three discrete positions.

The disclosed method relates to moving a driver from one of three positions to another of three positions. The method comprises: charging one of two spring assemblies; rotating one of two drive plates by discharging the one of the two spring assemblies; and moving a driver from one of three positions to another of the three positions while the one of two drive plates is rotating.

The disclosed apparatus also relates to a three position apparatus comprising: a means for charging one of two spring assemblies; and a means for moving a driver from one of three positions to another of the three positions by discharging the one of two spring assemblies.

BRIEF DESCRIPTION OF THE DRAWINGS

Referring now to the figures, which are exemplary embodiments, and wherein like elements are numbered alike.

DETAILED DESCRIPTION OF THE INVENTION

A detailed description of several embodiments of the disclosed apparatus and method are presented herein by way of exemplification and not limitation with reference to FIGS. 1 through 8.

Figure 1:
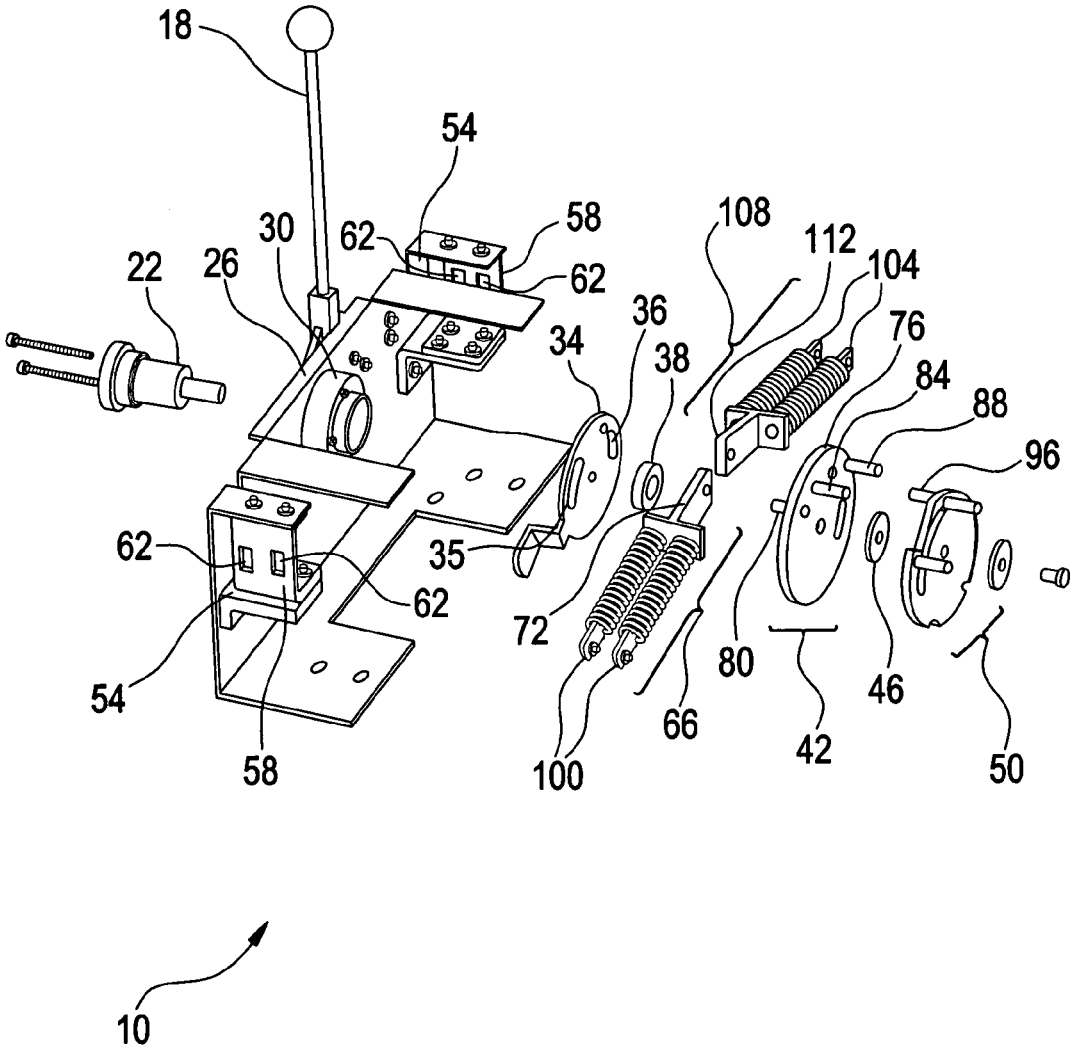
FIG. 1 depicts an exploded view of an exemplary apparatus in accordance with an embodiment of the invention.
Figure 2:
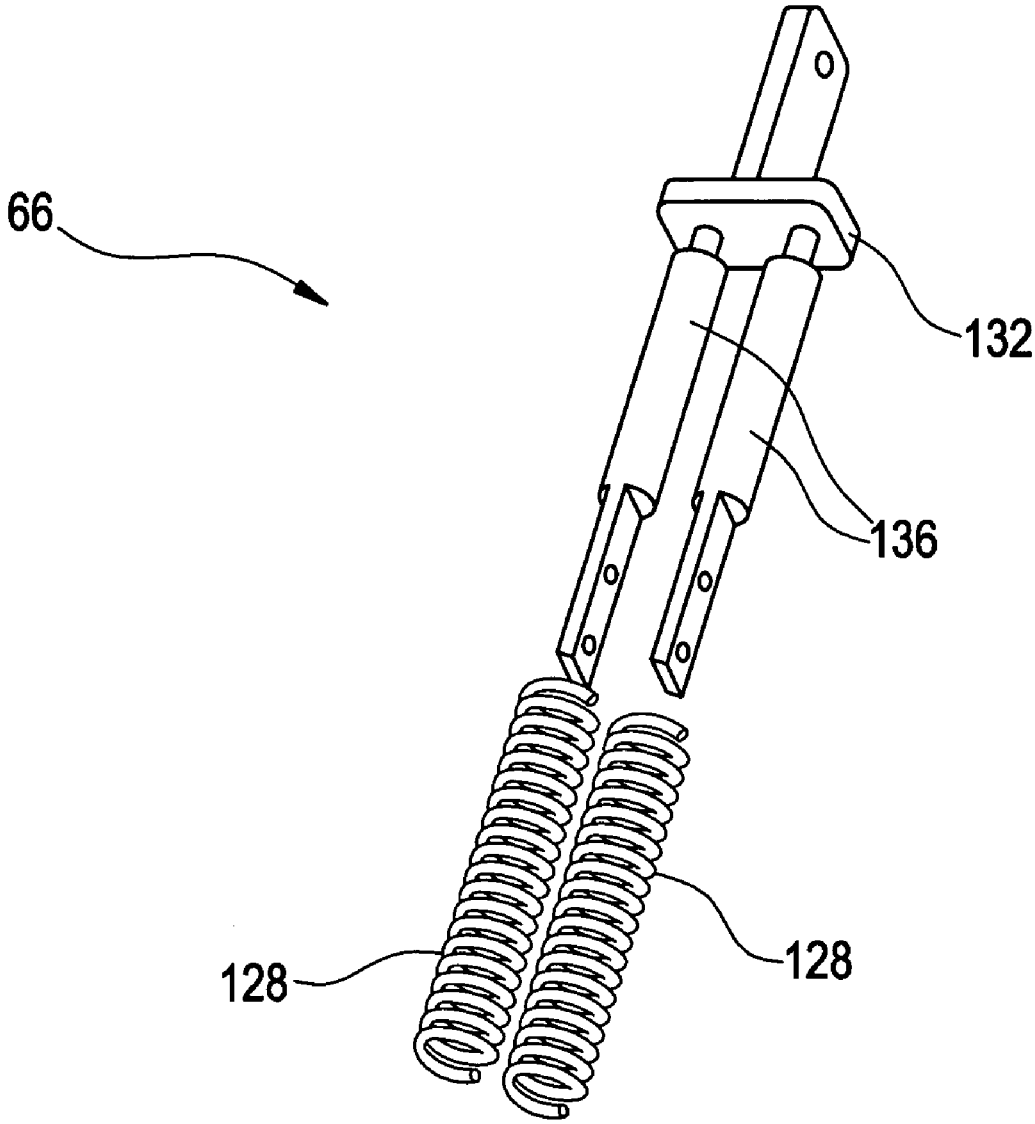
FIG. 2 depicts a perspective view of an exemplary first spring assembly in accordance with an embodiment of the invention.
Figure 3:
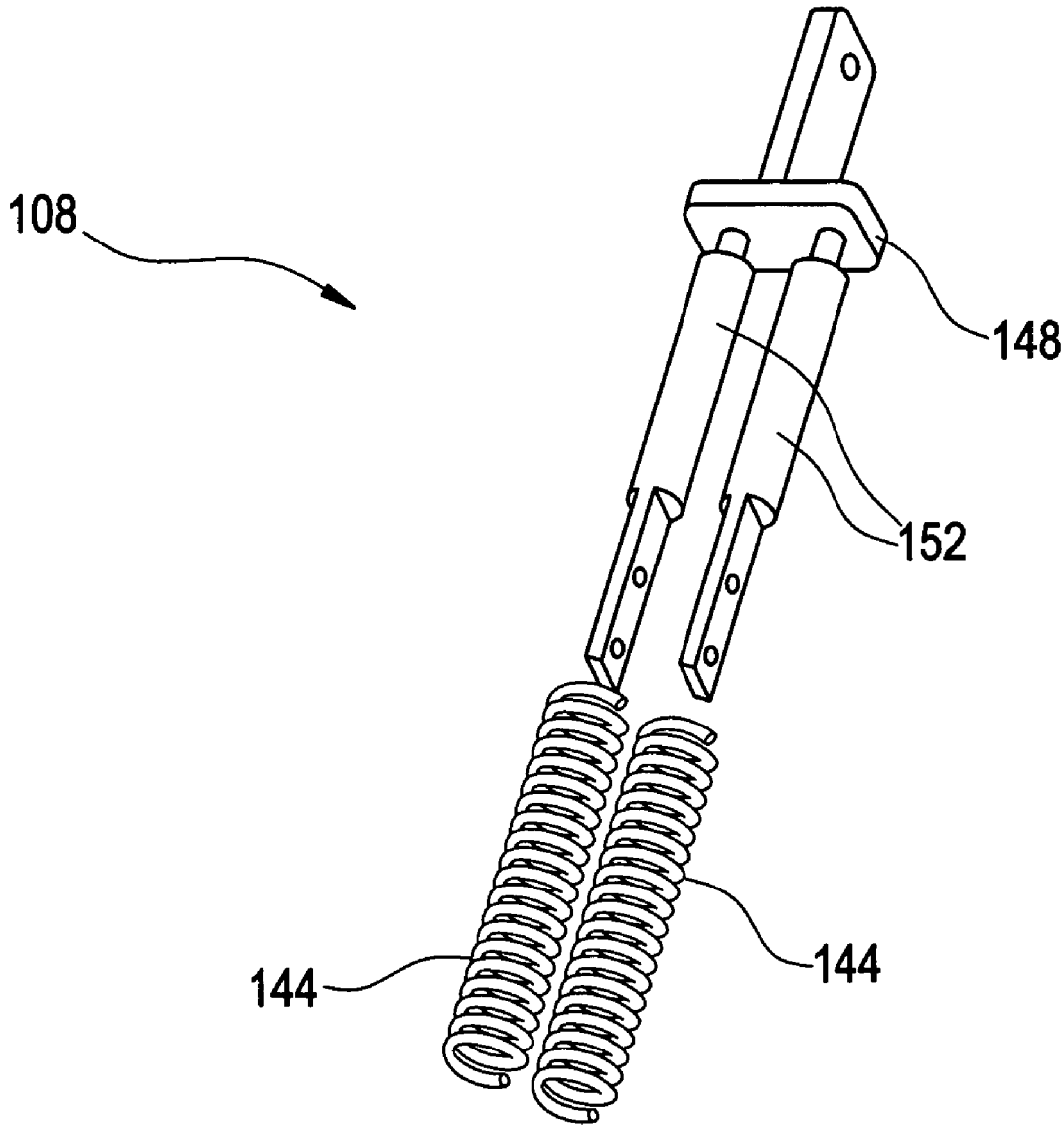
FIG. 3 depicts a perspective view of an exemplary second spring assembly in accordance with an embodiment of the invention.

An exploded perspective view of one embodiment of a three position apparatus 10 is shown in FIG. 1. In an embodiment, the three position apparatus 10 includes a handle 18, which when operated will rotate a spindle 22. The spindle is mounted in a mechanism bracket 26 and to which a spindle housing 30 is coupled to. The spindle carries the actuator plate 34, a spacer 38, a front drive plate assembly 42, a washer 46 and a drive plate assembly 50. The actuator plate has a right side slot 35, and a left side slot 36. The mechanism bracket 26 consists of two mounting brackets 54, each on either side of the spindle, on which the guide brackets 58 are placed. The guide brackets 58 have at least one slot 62, in which an end 100 of a first spring assembly 66 is guided and in which an end 104 of a second spring assembly 108 is guided. Referring to FIG. 2, the first spring assembly 66 may comprise two compression springs 128, a guide block 132 and two guide rods 136. Referring to FIG. 3, similarly the second spring assembly 108 may comprise two compression springs 144, a guide block 148 and two guide rods 152. The spring assemblies 66, 108 may be configured with different size or quantity of springs such that any force required for making or breaking the contacts of a switch can be achieved. Thus, this disclosed embodiment may be configured for switches with a wide variety of ratings.

Figure 4:
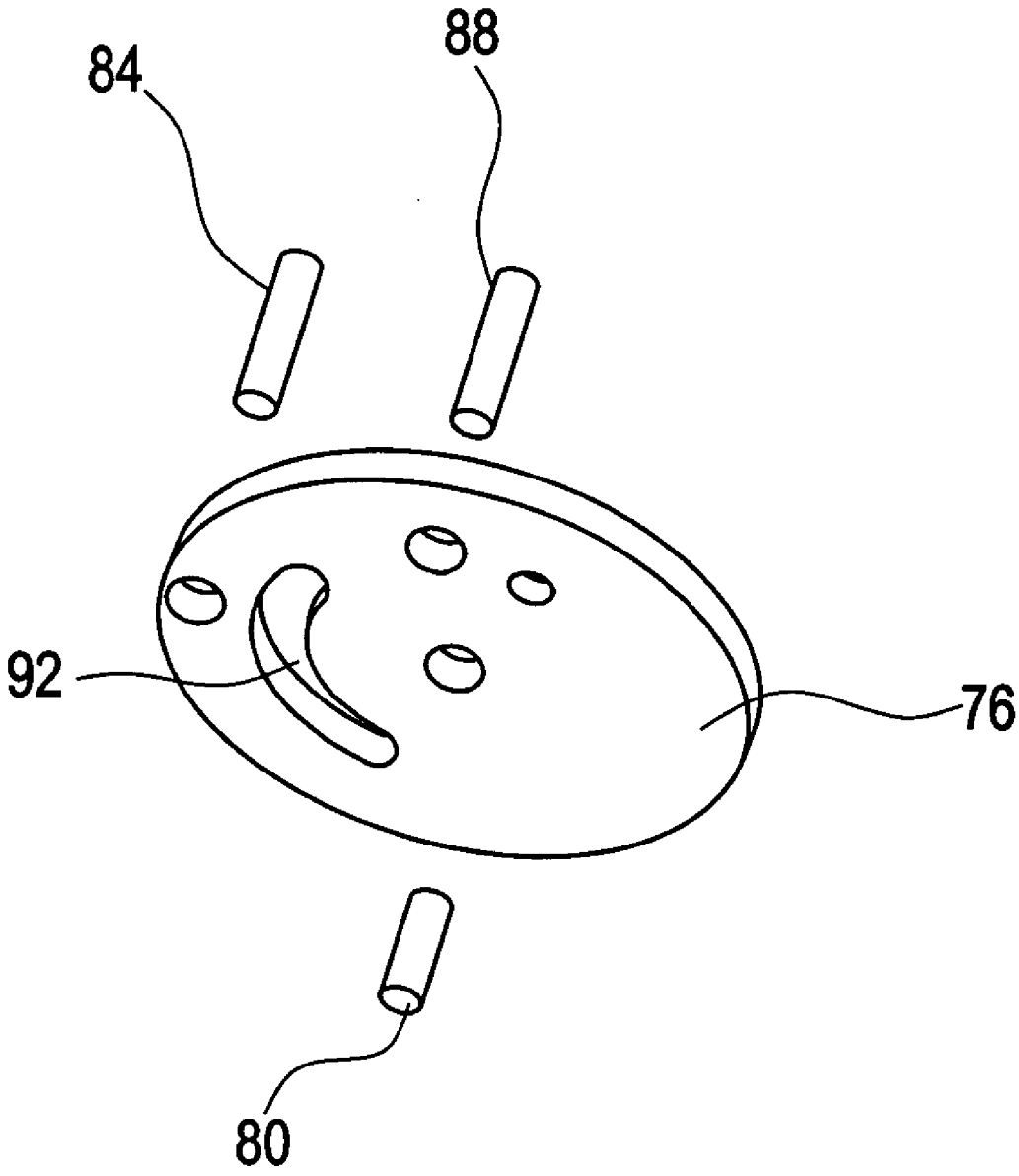
FIG. 4 depicts a perspective view of an exemplary front drive plate assembly in accordance with an embodiment of the invention.
Figure 5:
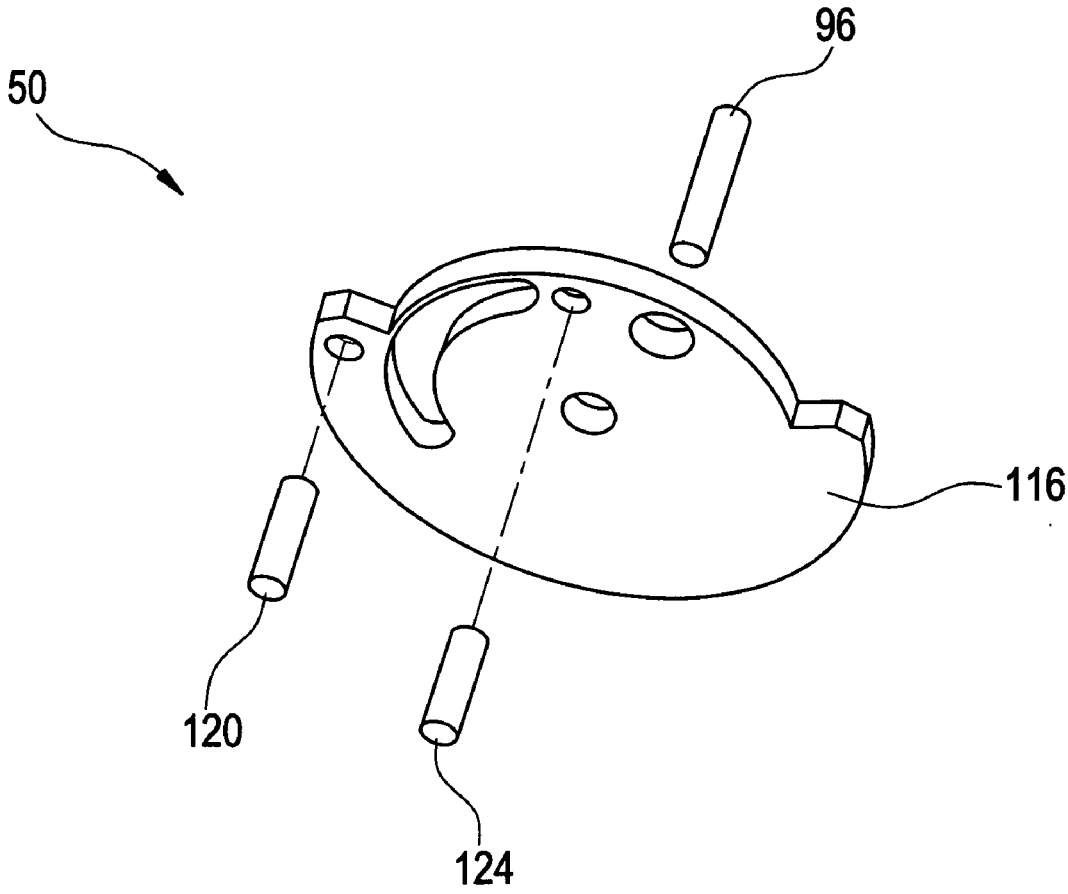
FIG. 5 depicts a perspective view of an exemplary rear drive plate assembly in accordance with an embodiment of the invention.

Referring back to FIG. 1, the other end of spring assemblies 66, 108 have a spring assembly members 72, 112, which are inserted between the actuator plate 34 and the front drive plate assembly 42. The front drive plate assembly 42 comprises a front drive disc 76, a first front drive pin 80, second front drive pin 84, and third front drive pin 88. The pin 80 is inserted in a hole in the first spring assembly member 72. Referring now to FIG. 4, the front drive disc 76 has a front drive slot 92, which allows a first rear drive pin 96 of the rear drive plate assembly 50 (referring back to FIG. 1) to be inserted into a hole in the second spring assembly member 112. This way the spring assemblies 66, 108 on either side of the spindle 22 controls the front drive plate assembly 42 and rear drive plate assembly 50. Referring to FIG. 5, the rear drive plate assembly 50 consists a rear drive disc 116, a first rear drive pin 96, a second rear drive pin 120 and a third rear drive pin 124.

Figure 6:
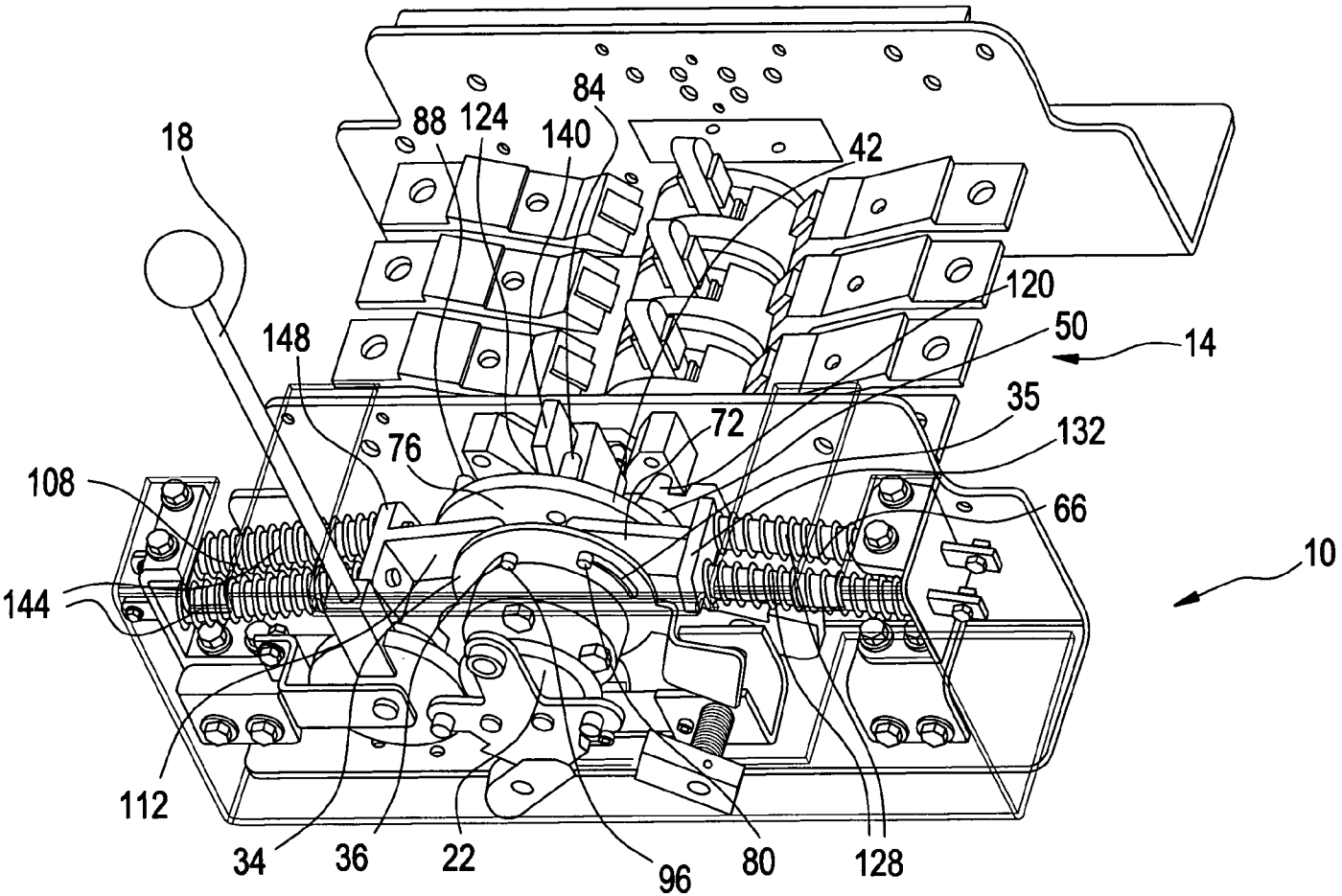
FIG. 6 depicts a perspective view of the exemplary apparatus of FIG. 1 in an open position.
Figure 7:
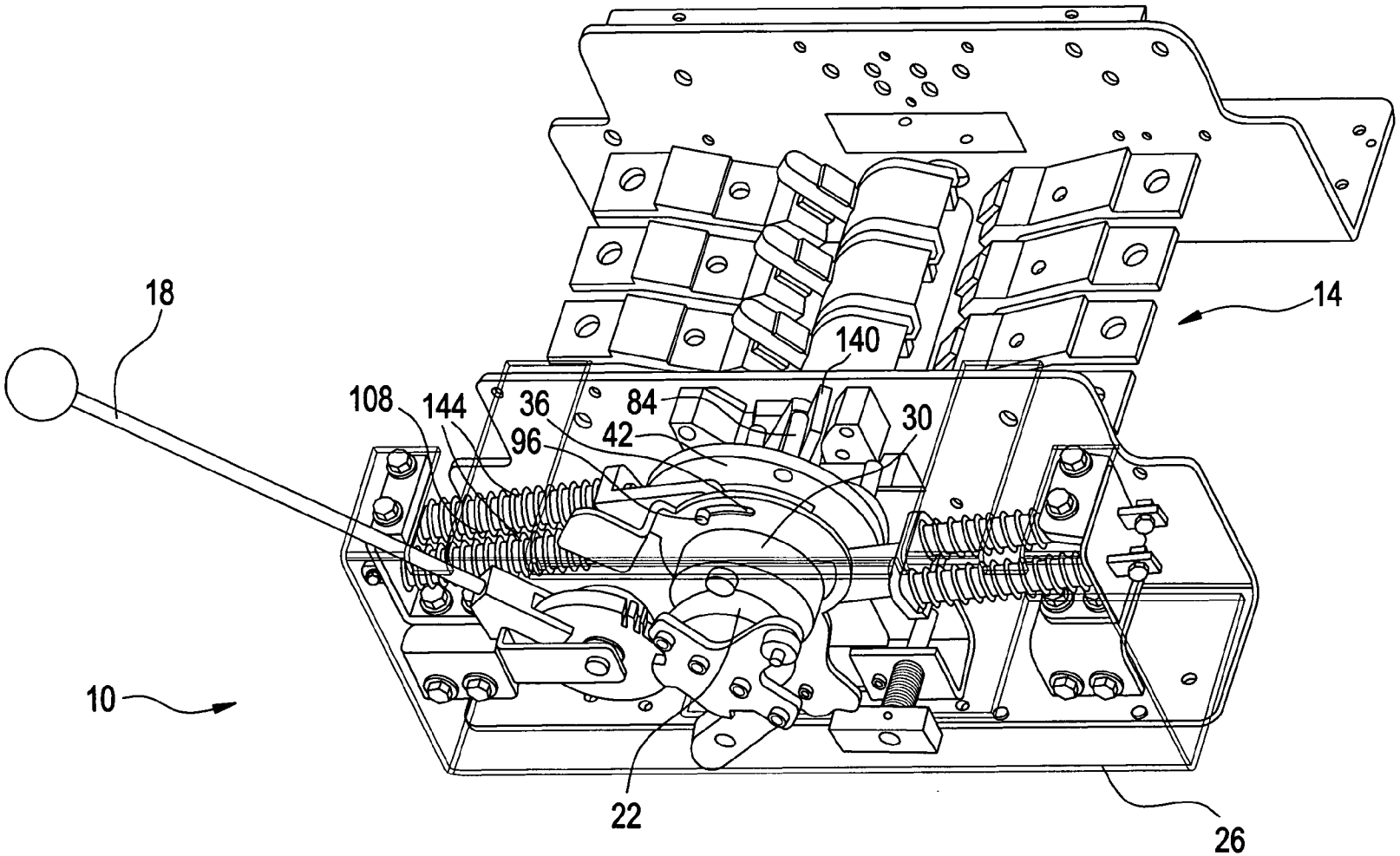
FIG. 7 depicts a perspective view of the exemplary apparatus of FIG. 1 in a left closed position.
Figure 8:
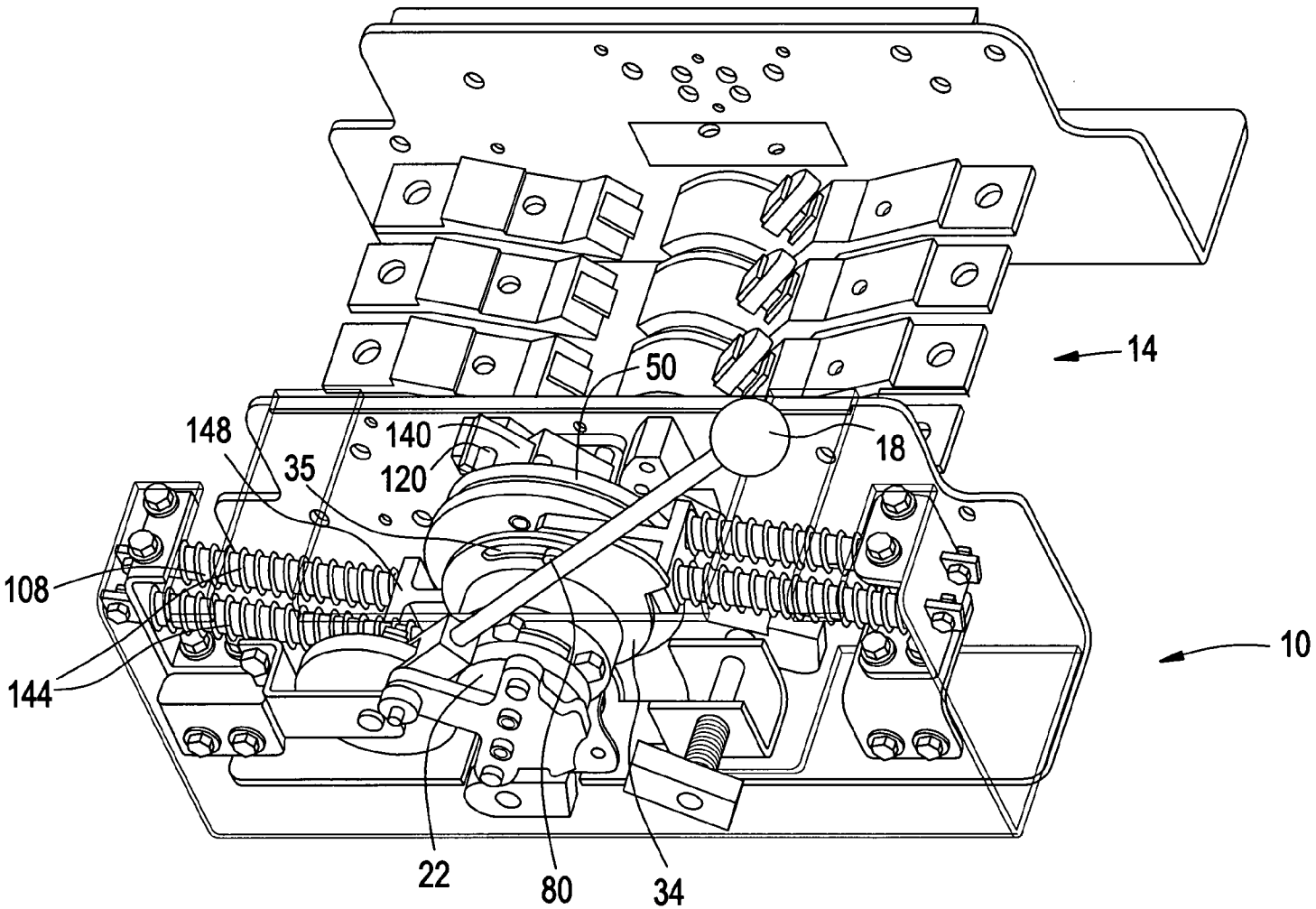
FIG. 8 depicts a perspective view of the exemplary apparatus of FIG. 1 in a right closed position.

Referring to FIG. 6, in this embodiment, the three position mechanism 10 is configured to function as an actuator for the electrical transfer switch 14. However, the three position mechanism may be used for a variety of equipment that requires positioning into three discrete positions.

Stage 1: This paragraph discusses how one embodiment of the disclosed apparatus operates, as the handle 18 is moved from an "open" position in FIG. 6, to a "left closed" position in FIG. 7. When the spindle 22 is rotated in clockwise direction (by pushing the handle in a counter-clockwise direction), the end of the right side slot 35 in the actuator plate 34 will push the pin 80 of the front drive disc 76 along with the spring assembly 66. The first spring assembly member 72 engages with pin 80 of the front drive plate disc assembly 42. The pin 80 is pushed by the end of the right side slot 35, which in turn pushes the guide block 132 which compresses (charges) the springs 128 of the first spring assembly 66. When the pin 80 along with the guide block 132 crosses a mid-way of the travel of the compression spring 128, the compression springs 128 will start discharging. During the discharge the front drive plate assembly 42 starts to rotate fast along with the two pins 84, 88. Pin 84 will hit a driver 140 of the switch 14 with high speed, pushing the driver to the right, thus causing the switch to make contact to the left. This results in the making of the contacts in the switch 14 very quickly. This way a quick-make connection may be achieved. A quick connection is one that has a sufficiently fast motion to avoid undue arcing and contact erosion during electrical switching.

Stage 2: This paragraph discusses how one embodiment of the disclosed apparatus operates as the handle 18 is moved from a "right closed" position in FIG. 8 to an open position in FIG. 6. The handle 18 starts in the right closed position. As the handle 18 is rotated in a counter-clockwise direction, the left side slot 36 of the actuator plate will slide over the pin 96 (not visible in FIG. 8, but visible in FIG. 6), until the end of the slot 36 comes in contact with the pin 96 and pushes the pin 96 in a clockwise direction. Now similarly as in Stage 1, the compression springs 144 of the second spring assembly 108 are compressed and charged until the guide block 148 crosses a mid-way of the travel of the compression spring 144 of the second spring assembly 108, at which point the compression springs 144 will start discharging, which in turn will rotate the rear drive plate assembly 50 faster. The pin 124 (not visible in FIG. 8, but visible in FIG. 6) of the rear drive assembly 50 will hit the driver 140 of the switch with high speed and in turn break the contact inside the switch 14. This way a quick-break is achieved.

Stage 3: This paragraph discusses how one embodiment of the disclosed apparatus operates as the handle 18 is moved from an "Open" position in FIG. 6, to a "right closed" position in FIG. 8. When the spindle 22 is rotated in a counter-clockwise direction, by turning the handle 18 in a clockwise direction, the end of the left side slot 36 in the actuator plate 34 will push the pin 96 of the rear drive assembly 50 along with the spring assembly 108. The guide block 148 has a member 112 in which pin 96 is inserted. When the pin 96 is pushed by slot 36, the guide block 148 compresses and charges the springs 144. When the pin 96 along with the guide block 148 crosses a mid-way of the travel of the compression spring 148 of the second spring assembly 108, the compression springs 144 will start discharging. During the discharge the rear drive assembly 50 starts to rotate fast in a counter-clockwise direction along with the two pins 120, 124. One of the pins 120 will hit the driver 140 of the switch 14 with high speed. This results in the making of the contacts in the switch 14 very quickly. Thus a quick-make is achieved.

Stage 4: This paragraph discusses how one embodiment of the disclosed apparatus operates as the handle 18 is moved from a "left closed" position in FIG. 7 to an open position in FIG. 6. When the handle 18 is rotated in a clockwise direction, the right side slot 35 will travel counter-clockwise until the end of the slot 35 contacts and moves the pin 80. As the pin 80 is moved to the left, the springs 128 are compressed and charged. When the pin 80 along with the guide block 132 crosses a mid-way of the travel of the compression spring 128 of the first spring assembly 66, the compression springs 128 will start discharging, and in turn will rotate the front drive plate assembly 42 faster. The pin 84 of the front drive assembly will hit the driver 140 of the switch 14 with high speed and in turn break the contact inside the switch 14, thus achieving a quick-break. In another embodiment, as the apparatus operates in stages 1, 2, 3 and 4, the charging spring may have assistance from the other spring assembly in accelerating the drive plate to hit a driver 140 of the switch 14 with high speed. Thus, as one spring assembly is charging by being compressed, the other spring assembly is charging by being expanded, hence the apparatus may be configured to use the stored energy in the expanding spring assembly to assist the charging spring assembly in rotating the drive plate. As the charging spring assembly discharges, the expanding spring assembly begins to contract (discharging the energy it has stored by being expanded), and assists the charging spring in rotating the drive plate.

An embodiment of a method for achieving three positions is now described. The method may comprise the acts of charging one of two spring assemblies, rotating one of two drive plates by discharging the one of the two spring assemblies, and moving a driver from one of three positions to another of the three positions while the one of two drive plates is rotating.

The disclosed apparatus and method allows for a replacement of the springs in the spring assemblies to allow for the apparatus to operate an extremely wide variety of switch sizes, among other equipment. Further the disclosed apparatus provides a quick make and a quick break, which may be equal to or less than about 200 milliseconds in one embodiment, equal to or less than about 100 milliseconds in another embodiment, or equal to or less than about 20 milliseconds in a further embodiment. The disclosed apparatus is relatively simple in design, and therefore would be lower in cost. Additionally, due to the relatively simple design, the apparatus would be compact in size.

While the embodiments of the disclosed method and apparatus have been described with reference to exemplary embodiments, it will be understood by those skilled in the art that various changes may be made and equivalents may be substituted for elements thereof without departing from the scope of the embodiments of the disclosed method and apparatus. In addition, many modifications may be made to adapt a particular situation or material to the teachings of the embodiments of the disclosed method and apparatus without departing from the essential scope thereof. Therefore, it is intended that the embodiments of the disclosed method and apparatus not be limited to the particular embodiments disclosed as the best mode contemplated for carrying out the embodiments of the disclosed method and apparatus, but that the embodiments of the disclosed method and apparatus will include all embodiments falling within the scope of the appended claims.

What is claimed is:

1. A three position apparatus for operating a driver in operable communication with a switch, the apparatus comprising:

an actuator plate;

a first spring assembly in operable communication with the actuator plate;

a second spring assembly in operable communication with the actuator plate;

a first drive plate in operable communication with the actuator plate and first spring assembly; and a second drive plate in operable communication with the actuator plate and second spring assembly;

wherein the first drive plate and the second drive plate are in operable communication with the driver; and wherein the three position apparatus is configured to provide quick movement of the driver to at least three discrete positions.

2. The three position apparatus of claim 1, further comprising:

a spindle in operable communication with the actuator plate.

3. The three position apparatus of claim 2, further comprising:

a handle in operable communication with the spindle.

4. The three position apparatus of claim 1, wherein the switch is an electrical switch.

5. The three position apparatus of claim 1, wherein the apparatus is configured to make an electrical connection in the switch in less than 100 milliseconds.

6. The three position apparatus of claim 1, wherein the apparatus is configured to break an electrical connection in the switch in less than 100 milliseconds.

7. The three position apparatus of claim 1, wherein the electrical switch is a 400 ampere switch.

8. The three position apparatus of claim 1 configured such that the driver can be moved from one of the three positions to another of the three positions in less than 100 milliseconds.

9. The three position apparatus of claim 1, wherein the actuator plate is configured to charge the first spring assembly such that when the first spring assembly is discharged, the first drive plate rotates and causes the driver to move from one of three positions to another of the three positions.

10. The three position apparatus of claim 1, wherein the actuator plate is configured to charge the first spring assembly such that when the first spring assembly is discharged, the second drive plate rotates and causes the driver to move from one of three positions to another of the three positions.

11. The three position apparatus of claim 1, wherein the actuator plate is configured to charge the second spring assembly such that when the second spring assembly is discharged, the first drive plate rotates and causes the driver to move from one of three positions to another of the three positions.

12. The three position apparatus of claim 1, wherein the actuator plate is configured to charge the second spring assembly such that when the second spring assembly is discharged, the second drive plate rotates and causes the driver to move from one of three positions to another of the three positions.

13. The three position apparatus of claim 1, wherein the actuator plate is configured to charge the first spring assembly and second spring assembly such that when the first spring assembly and second spring assembly are discharged, the first drive plate rotates and causes the driver to move from one of three positions to another of the three positions.

14. The three position apparatus of claim 1, wherein the actuator plate is configured to charge the first spring assembly and second spring assembly such that when the first spring assembly and second spring assembly are discharged, the second drive plate rotates and causes the driver to move from one of three positions to another of the three positions.

15. The three position apparatus of claim 1, where the first and second spring assemblies comprise springs that may be replaced with different size springs.

16. The three position apparatus of claim 1, wherein the three discrete positions are left closed, open and right closed.

17. A method of moving a driver from one of three positions to another of three positions, the method comprising:

charging one of two spring assemblies;

rotating one of two drive plates by discharging the one of the two spring assemblies; and moving the driver from one of three positions to another of the three positions while the one of two drive plates is rotating.

18. The method of claim 17 further comprising:

rotating an actuator plate in operable communication with the one of two spring assemblies.

19. The method of claim 18 further comprising:

rotating a spindle in operable communication with the actuator plate.

20. The method of claim 19 further comprising:

moving a handle in operable communication with the spindle.

21. A three position apparatus for operating a driver in operable communication with a switch, the apparatus comprising:

means for charging one of two spring assemblies, one of the spring assemblies being in operable communication with a first drive plate and the other of the spring assemblies being in operable communication with a second drive plate; and means for moving the driver from one of the three positions to another of the three positions by discharging the one of two spring assemblies thereby driving one of the first drive plate and the second drive plate.

* * * * *